United States Patent [19]

Maney

[11] 4,286,338

[45] Sep. 1, 1981

[54] ADJUSTABLE PAPER CAP

[76] Inventor: Thomas P. Maney, 535 Greenglade Ave., Worthington, Ohio 43085

[21] Appl. No.: 195,479

[22] Filed: Oct. 9, 1980

[51] Int. Cl.[3] ..... A42B 1/00; A42B 1/22

[52] U.S. Cl. ..... 2/197

[58] Field of Search ..... 2/197, 195, 181, 183

[56] References Cited

U.S. PATENT DOCUMENTS

| | | | |
|---|---|---|---|
| 4,213,206 | 7/1980 | Maney | 2/197 |
| 4,244,058 | 1/1981 | Randall | 2/197 |

*Primary Examiner*—Peter P. Nerbun

*Attorney, Agent, or Firm*—Robert E. Stebens

[57] ABSTRACT

An adjustable paper cap is provided as an article of protective head gear particularly adapted for use in food serving and processing facilities as well as in various other types of factories or manufacturing facilities. The cap includes two elongated side panels, one of which has two sections that are telescopically adjustable in a longitudinal direction for accommodating size adjustment. A crown fabricated from a relatively thin and flexible sheet material formed with a multiplicity of pleats to permit substantial lateral expansion and is secured between the side panels. Each side panel is formed with relatively narrow, single-folded, longitudinally extending, upper and lower marginal edge portions which enable the two sections of the one panel to telescopically interfit in securely retained relationship. The crown is attached to the side panels through adhesive bonding of the outermost panel of the pleated crown to a marginal edge portion of the respective side panel. Only a folded over, vertical end portion of the crown is secured to the side panel section to minimize interference in telescoping of the two sections while maintaining the unattached portions of the crown in close association with the adjacent panel surface. One embodiment features attachment of the crown to the lower marginal edge, with the vertical end portion of the crown projecting upwardly. Another embodiment features attachment of the crown to the upper marginal edge, with the vertical end portion of the crown projecting upwardly. A third embodiment features attachment of the crown to the upper marginal edge, with the vertical end portion of the crown projecting downwardly.

17 Claims, 16 Drawing Figures

ADJUSTABLE PAPER CAP

BACKGROUND OF THE INVENTION

This disposable adjustable paper cap is designed to reconcile the often opposing goals of comfort and safety in cap construction. While many other adjustable paper caps have been designed, those known designs tend to either emphasize safety with a resulting loss of comfort, or emphasize comfort while compromising as to safety. Today, paper caps are widely used by individuals concerned with food preparation and employed in industry to provide protection for themselves as well as consumers. Regulations often necessitate the wearing of some type of cap throughout the course of the work day.

Paper caps ideally should effectively cover a maximum amount of hair to aid in compliance with health and occupational safety regulations. Yet, paper caps should also be comfortable to allow the wearer to not feel inconvenienced in having to wear a cap while working. This comfortable fit should allow current "full-bodied" hair styles to have a snug fit instead of a loose uncomfortable one. Known examples of cap construction of the type to which this invention is directed are illustrated in U.S. Pat. No. 2,669,725 issued to O. P. Haegele on Feb. 23, 1954 and U.S. Pat. No. 3,390,405 issued to W. I. Gruber on July 2, 1968. These patents, although exemplary of prior cap constructions of this type, do not disclose caps which possess the advantages and improved functioning of the cap construction disclosed herein. The Haegele patent discloses a cap wherein the crown is secured to the outer panel walls and those panels have longitudinal marginal edge portions which are multiple folded.

Attachment of the outer panel wall restricts expansion of the cap and severely limits the volume of hair capable of being covered. Additionally, the lack of ovelapping marginal edges decreases the rigidity of the outer panel, thus distracting from its aesthetic appearance. Furthermore, the lack of rigidity is compensated by an additional web which increases the cost of production, while still not providing the rigidity desired by wearers.

In Gruber, the crown is secured to the upper longitudinal marginal edge portion of the side panels that are folded inwardly and the lower longitudinal marginal edge portion is multiple folded. While attachment to the upper marginal edge is an improvement over attachment to the outer wall as in Haegele, the problem with rigidity still exists. Based upon the prior teaching of Haegele and his additional web, Gruber also utilizes a multi-folded lower edge portion. However, instead of assuring rigidity, the added width at the cap's bottom causes the side walls to be slightly inwardly inclined as they approach the top.

Other known examples of cap construction of the type to which this invention is directed are illustrated in applicant's prior patents. U.S. Pat. Nos. 4,186,446 and 4,213,206. Pat. No. 4,186,446 discloses a cap with its crown secured to the upper marginal edge portion. In seeking to provide rigidity, this patent eliminated the multifolded marginal edge portions in an attempt to equalize the widths at the cap's top and bottom which had proved troublesome in Gruber. Furthermore, this cap relied on attachment of the crown to the upper marginal edge with its outermost crown pleats directed in an upwards direction. Pat. No. 4,213,206 discloses a cap with its crown secured to the lower marginal edge, but more importantly a cap with its marginal edge portions in overlapping relationship to one another.

To provide greater rigidity, the marginal edge portions were overlapped. Additionally, the means of attachment permitted the lower marginal edge to function as part of the crown.

SUMMARY OF THE INVENTION

This invention is directed to the providing of a cap construction having a pair of longitudinally extending side panels interconnected at their forward and rearward ends with one of the panels being telescopically adjustable to permit selective size adjustment. These side panels are each formed with inwardly turned, marginal edge portions at the top and bottom thereof. One side panel is formed in two sections that are adapted to telescopically interconnect through interengagement of the overlapping folded over marginal edge portions.

A crown is provided to extend across the upper portions of the two side panels and is formed from a sheet of flexible material with a plurality of pleats to accommodate expansion through relative separation of the two side panels. In accordance with this invention, the opposite sides of the crown are adhesively secured to a marginal edge portion of each panel, except for one section of the one side panel, in a manner to materially enhance the capability of the cap to be adjusted to the larger sizes. This capability permits an extremely comfortable, yet snug "engineered" fit to be achieved. This "engineered" fit is deemed to be a definite improvement over telescopically adjustable caps where the attachment of the crown is made to the upper marginal edge portion of caps not having overlapping marginal edge portions. Poorly fitting caps must either be adjusted to a very snug position in order to remain on the head or else remain loose. Either alternative causes workers discomfort both physically and emotionally. This worker discomfort results in reduced productivity and efficiency. This invention's "engineered" fit provides for a cap that aids in significantly reducing the discomfort associated with the wearing of other adjustable caps.

Furthermore, this cap's overlapping marginal edge portions additionally serve to form a locking effect to assure a better fit by maintaining the desired cap circumference. The overlap occurs at the mid-point of the longitudinal panels. Additionally, the amount of the overlap is a minimum so as to conserve paper, thereby reducing the cost. Finally, both marginal edge portions are a single layer, thereby also contributing to the reduced amount of paper needed and the lower cost.

This invention features three embodiments. The first embodiment has overlapping marginal edge portions with the lower edge portion projecting a distance upward to partially cover the upper edge portion. Also, the outermost pleat panel of the crown projects upwardly and is secured to an inwardly facing surface of the lower marginal edge portion. The second embodiment has overlapping marginal edge portions with the upper edge portion projecting a distance downward to partially cover the lower edge portion. Also, the outermost pleat panel projects downwardly and is secured to an inwardly facing surface of the upper marginal edge portion. The third embodiment has overlapping marginal edge portions with the upper edge portion projecting a distance downward to partially cover the lower edge portion. Also, the outermost pleat panel projects upwardly and is secured to an inwardly facing surface of the upper marginal edge portion.

It is an important object of this invention to provide an adjustable paper cap capable of having an extremely comfortable fit, yet efficiently effectuate coverage of the hair in compliance with occupational safety and health standards.

In addition, it is an object of this invention to accomplish effective coverage of the hair by a comfortable cap by means of a minimum amount of materials.

It is another object of this invention to provide an adjustable paper cap capable of accommodating a large volume of hair, but also because of its adjustable nature capable of providing a snug fit for those hair styles emphasizing a small volume of hair.

Still further, it is an object of this invention that this cap should be capable of reducing the transmission of perspiration.

Furthermore, it is an object of this invention that this cap should be disposable and inexpensive to purchase, yet attractive to wear with the achievement of this object aided by the use of a relatively greater proportion of inexpensive materials.

Additionally, it is an object of this invention to provide a cap having rigidity, a locking effect, and maximum volume capability.

It is a further object of this invention to provide a cap with overlapping marginal edges in which a marginal edge functions as part of the crown.

The above and still further features, objects, and advantages of the present invention will become apparent upon consideration of the following detailed description of a specific embodiment thereof. Reference will be had to the accompanying drawings which illustrate several embodiments of the invention.

DESCRIPTION OF THE DRAWING FIGURES

DESCRIPTION OF THE ILLUSTRATIVE EMBODIMENT

Figure 1:
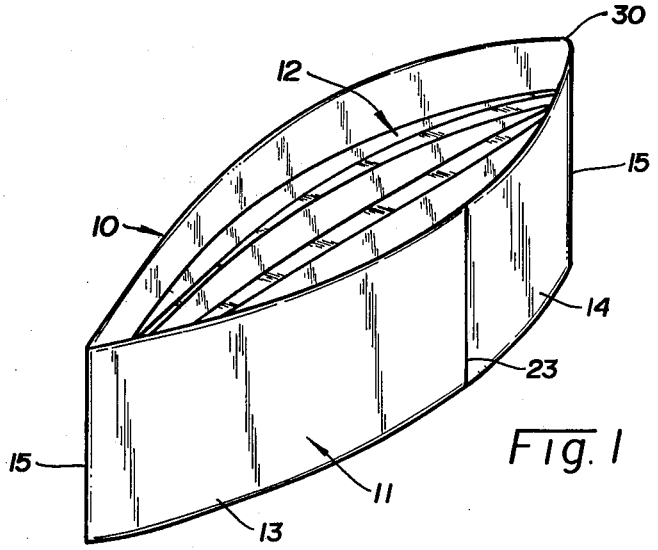
FIG. 1 is a perspective view of an adjustable paper cap construction embodying this invention.
Figure 2:
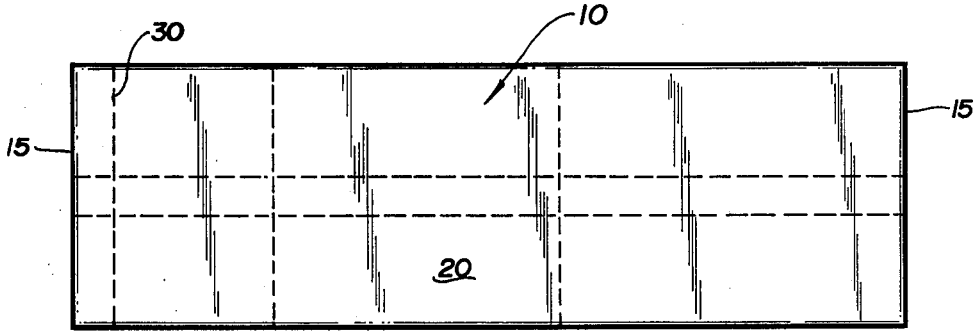
FIG. 2 is an elevational view on an enlarged scale of a first side panel as viewed from the reverse side of FIG. 1.
Figure 3:
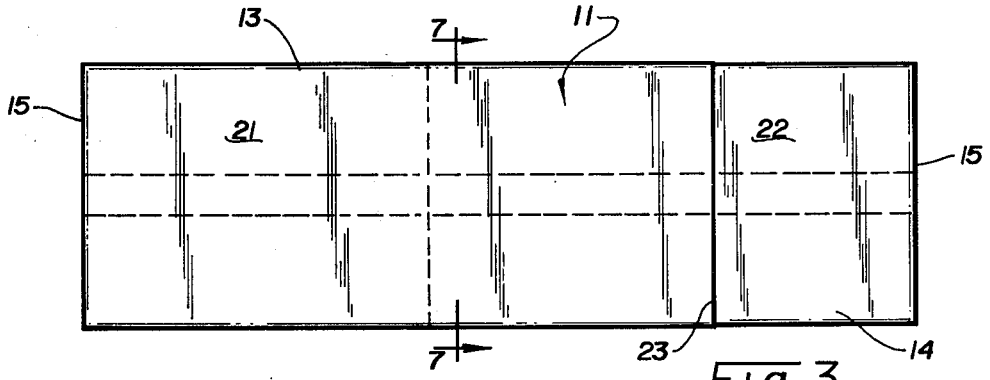
FIG. 3 is an elevational view on an enlarged scale of a second side panel of the cap as seen from the front of FIG. 1.

Having reference to the drawings, attention is directed to FIG. 1 which shows an adjustable paper cap embodying this invention. This cap incorporates the general configuration of other known caps of a similar type and includes a pair of longitudinally extending side panels 10 and 11 and a crown 12 disposed between the side panels and extending across the space therebetween as the cap is expanded to conform to a particular person's head configuration. FIGS. 2 and 3 are side elevational views of a cap and illustrate a complete enclosure of the crown within the coextensive area of the panels when the cap is in a flat folded configuration. Also, it will be seen in FIG. 2 that one of the side panels 10 is of a unitary construction while the second side panel 11 is formed in two sections that may be designated as the front and rear sections 13 and 14 as shown in FIG. 3.

Figure 4:
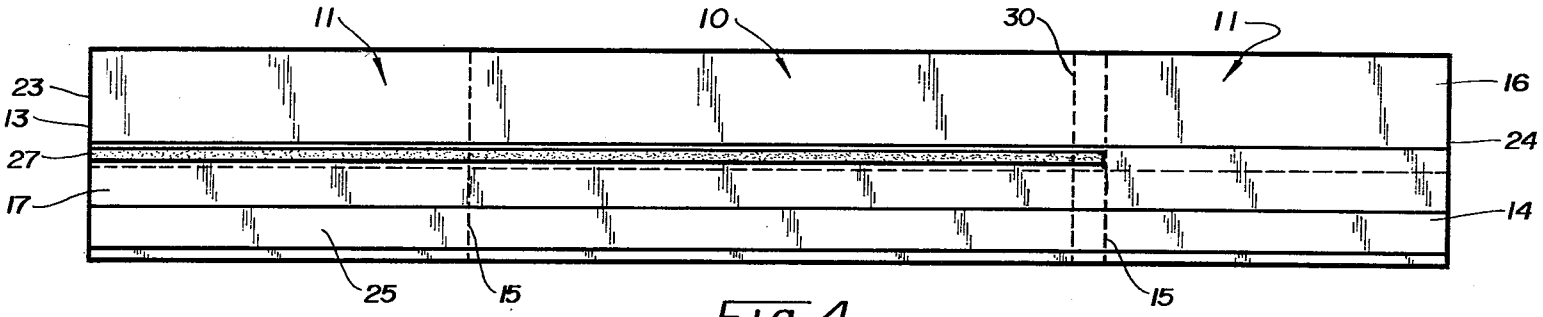
FIG. 4 is an elevational view of an enlarged scale of the interior face of the side panels when unfolded to a flat configuration showing the relation of the first side panel to the two sections of the second side panel.

General construction of the two panels will be better understood with reference to FIG. 4 which shows the two panels 10 and 11 disposed in a relatively unfolded configuration and without the crown. This is the configuration of the two panels upon their completion as a subassembly prior to folding assembly with the crown 12. In this view, which is a view of the panel surfaces which will be inwardly facing when folded, it will be seen that the front and rear sections 13 and 14 which will ultimately be assembled to form the second panel 11, are integrally formed with the first panel 10 as extensions or continuations thereof. Each section is distinguishable from the first panel by the respective scored fold line 15 that extends transversely across the panels.

Upper and lower marginal edge portions 16 and 17 extending along the respective edges of panel 10 and panel sections 13 and 14 are folded inward along upper and lower fold lines 18 and 19 relative to the main outer wall 20 of the first panel 10 and 21, 22 of the second panel sections 13, 14. In accordance with this invention, these marginal edge portions are of a relatively equal width of approximately 5.0 centimeters compared to the total panel width of about 9 centimeters in the case of a cap with the first panel 10 having a length of about 28 centimeters. These dimensions are by way of example and it will be understood that a particular hat may be otherwise dimensioned, although preferably, the illustrative proportions would be retained. It will be noted that in the first embodiment of the invention, shown in FIGS. 7–9, there is an overlap of the two marginal edge portions of approximately 1 centimeter with the lower marginal edge portion 17 overlapping the upper marginal edge portion 16, while in the other embodiments of this invention, it is the upper marginal edge portion which overlaps the lower marginal edge portion. It will also be noted that the front and rear sections 13 and 14 have their respective free ends 23 and 24 appropriately dimensioned to permit telescopic interfitting when assembled to form the second side panel 11 as shown in FIGS. 1 and 3. When thus assembled, the free end 24 of the rear section has edges thereof inserted between the opposed surfaces of the outer wall 21 of the first section and associated upper and lower marginal edge portions 16 and 17.

In all of the embodiments, the lower marginal edge portion 17 also functions as a sweat band. Since the panels 10 and 11 are preferably formed from sheet form paper material that is not necessarily impervious to moisture, the inwardly facing surface thereof is advantageously coated with a wax-like substance or other suitable material that is less susceptible to absorption of moisture to thereby inhibit transmission of moisture to the underlying paper material and to the main outer walls 20, 21 and 22. This moisture-impervious coating indicated at 25 is formed as a strip of much lesser width than the width of the edge portion and may be of the order of 2.0 centimeters wide and extends the entire length of the panels. A lesser width of such a coating may not provide the desired protection whereas a greater width will not be economically useful. Additionally, lesser widths would tend to decrease the efficiency of the cap in situations inducing substantial perspiration, thereby resulting in reduced cap life.

Figure 5:
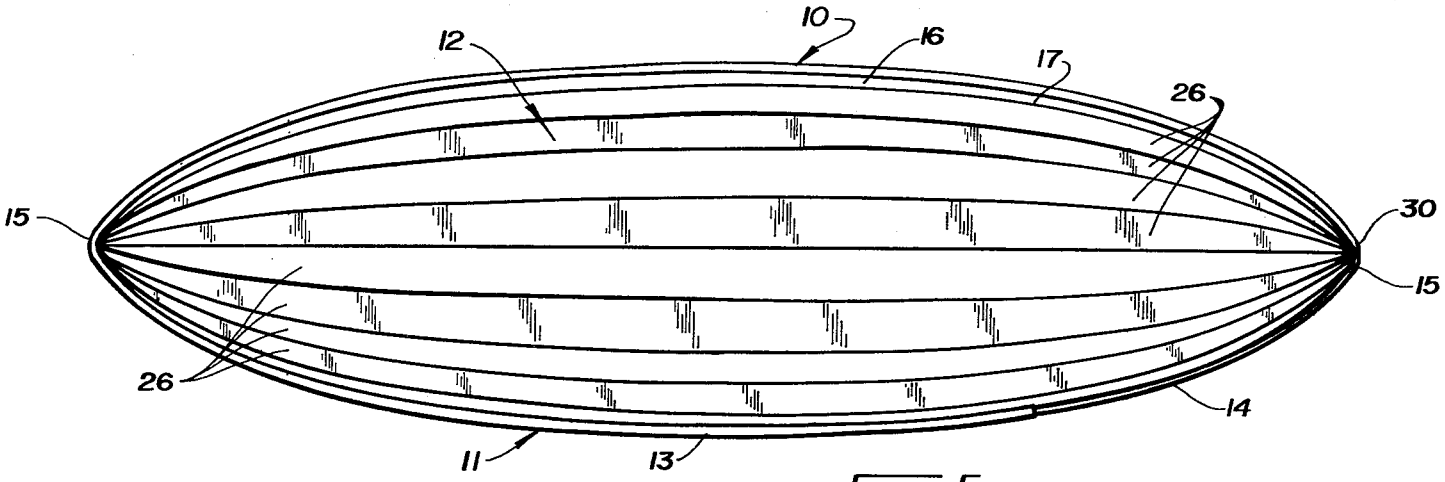
FIG. 5 is a top plan view of an opened cap disclosing the crown structure.
Figure 11:
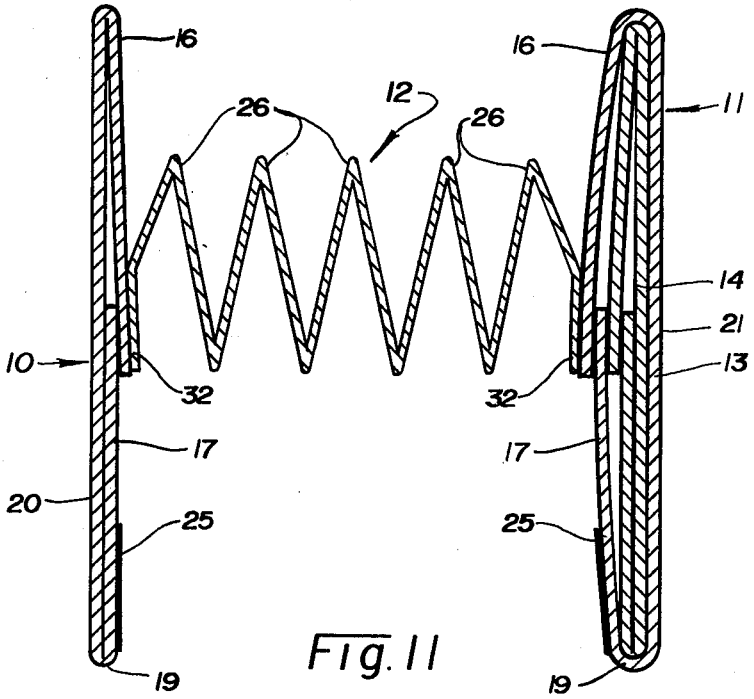
FIG. 11 is a vertical sectional view on an enlarged scale of a modified embodiment of an adjustable paper cap wherein the outermost pleat is secured to the upper marginal edge portion and directed in a downward direction.
Figure 13:
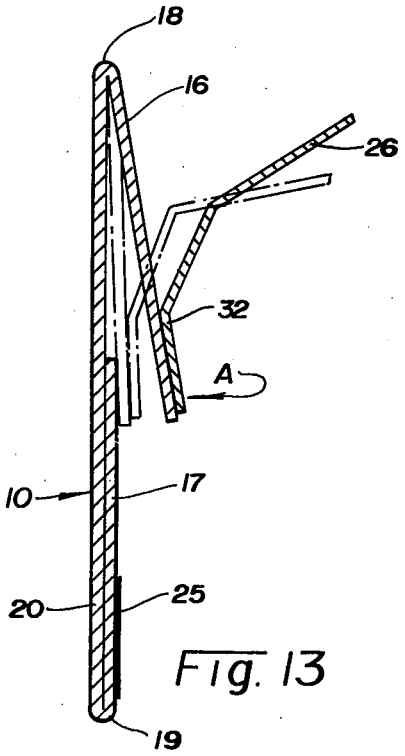
FIG. 13 is a fragmentary vertical sectional view similar to FIG. 11 illustrating functioning of the cap.
Figure 12:
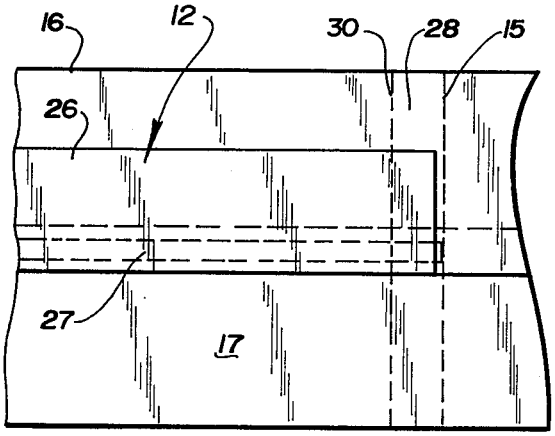
FIG. 12 is a fragmentary elevational view of a modified embodiment portion of the interior face of the side panels at the rear fold line juncture with the crown attached as disclosed in FIG. 11.
Figure 14:
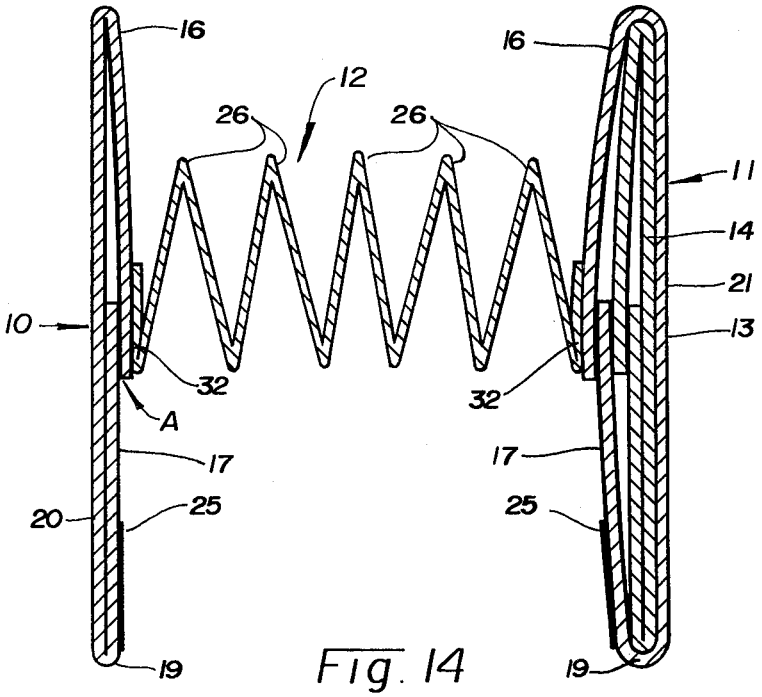
FIG. 14 is a vertical sectional view on an enlarged scale of a modified embodiment of an adjustable paper cap wherein the outermost pleat is secured to the upper marginal edge portion and directed in an upward direction.
Figure 16:
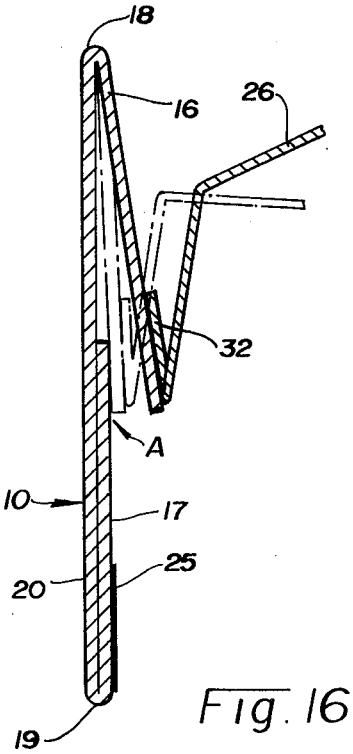
FIG. 16 is a fragmentary vertical sectional view similar to FIG. 14 illustrating functioning of the cap.
Figure 15:
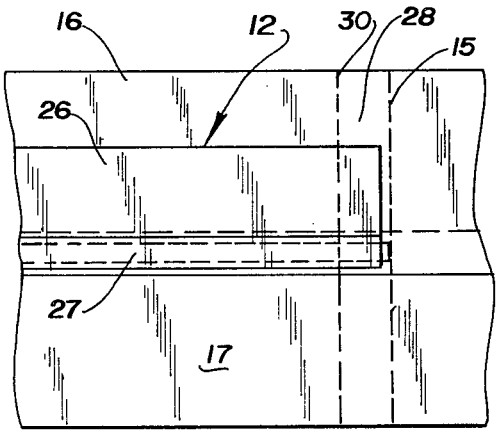
FIG. 15 is a fragmentary elevational view of a modified embodiment of a portion of the interior face of the side panels of the rear fold line juncture with the crown attached as disclosed in FIG. 14.

Secured to the upper edge of the lower marginal edge portions of panels 10 and 11 in the first embodiment is the crown 12, which is formed from a sheet-form paper material that is of a relatively thinner structure than the side panels and is consequently more flexible to enable the crown 12 to adequately expand in a combination of volume requirements. In the two other embodiments of this invention which are disclosed, the crown 12 is secured to the lower edge of the upper marginal edge portion 16. The crown 12 is formed in a multiple pleat configuration which, in the illustrative embodiments, has 8 pleat panels 26 of an approximate width of 3 centimeters. Positioning of the crown between the panels 10 and 11, which crown extends the full length of panels 10 and 11 as can be seen in FIG. 5, is clearly illustrated in FIG. 7 where the two side panels are disposed in a separated or expanded position. In the first embodiment, shown in FIGS. 7–9, it will be noted that although the two outermost panels project in a relatively downward direction from the last fold towards marginal edge portion 17, the crown is actually secured by means of an upturned flap 32 to which an appropriate adhesive material has been applied. In the second embodiment, as shown in FIGS. 11–13, the two outermost panels also project in a relatively downwardly direction from the last fold, but are disposed in coextensive relationship to the adjacent surfaces of the upper marginal edge portion 16. In the third embodiment, as shown in FIGS. 14–16, while the two outermost panels of the crown 12 project in a relatively downward direction from the last fold, the attachment to the upper marginal edge portion is effected by adhesion to an upturned flap 32, as in the first embodiment.

Figure 10:
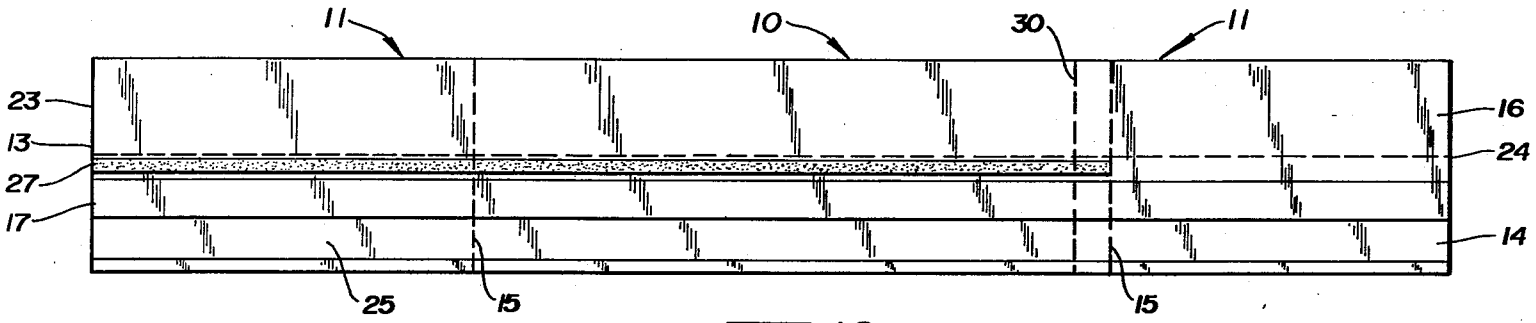
FIG. 10 is an elevational view on an enlarged scale of the interior face of the side panels when unfolded to a flat configuration in a modified embodiment showing the relation of the first side panel to the two sections of the second side panel, wherein the upper marginal edge portion overlaps the lower marginal edge portion.

Such an adhesive material may be applied as a strip-form layer 27 on the top peripheral edge of the lower marginal edge portion for the first embodiment. This is done when the panels are disposed in an unfolded configuration as shown in FIG. 4. For the second and third embodiments, the adhesive is applied on the lower peripheral edge of the upper marginal edge portion. This is done when the panels are disposed in an unfolded configuration as shown in FIG. 10. For all three embodiments, the adhesive strip 27 is generally applied only to the front section of the second side panel 11 and to the first side panel 10, as shown in FIGS. 4 and 10. The adhesive strip 27 is continued for a short distance beyond a crease line 30 associated with the rear section of the first side panel 10, but terminates at the fold line 15 to allow for a more comfortable fit of the adjustable paper cap as that will be further explained. In these embodiments, the adhesive strip 27 is relatively narrower being of the order of 0.5 centimeters. It will also be noted by reference to FIG. 5 where the crown 12 is completely assembled with the side panels 10 and 11 that the outermost pleat panel 26 is not adhesively secured to the rear section 14 of the side panel 11 to permit telescopic interconnection of the two sections.

Figure 6:
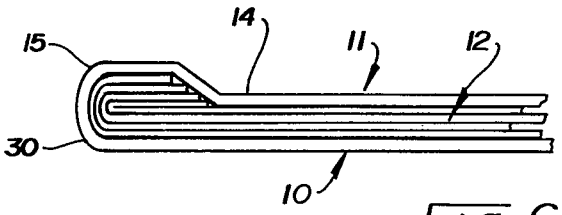
FIG. 6 is a fragmentary top plan view on a substantially enlarged scale of a rear portion of a cap in a folded configuration.

Also, in accordance with this invention, the crown 12 is of a slightly greater length than the first side panel 10 and can conveniently be described as having a vertical end edge portion 28. This greater length can be best seen in FIG. 6 which is a fragmentary top plan view of the cap on a substantially enlarged scale and can also be seen in the enlarged scale elevational view of FIGS. 8, 12 and 15. In assembly of the crown 12 with the side panel 10, the rear end of the crown is aligned with the fold line 15 at the juncture thereof with the second panel's rear section 14. At this point in fabrication of a cap, the rear portion of panel 10 is folded along the crease line 30 to cause the creation of the vertical end edge portion 28. This folding operation also results in a slight longitudinal separation of the pleat panels 26 and upturned flap 32 for the first and third embodiments, such that the adhesive flows onto the ends of the panels, thereby causing the ends of the upturned flap and panels to be secured to the end of panel 10. The portion of the crown which is secured to the first panel 10 in this fashion involves the area of the crown which lies between crease line 30 and fold line 15.

The illustrated techniques of attachment of the crown are of great importance in achieving the objectives of the adjustable paper cap of this invention. It is again emphasized that an extremely important object of this invention is to provide an adjustable paper cap capable of having an extremely comfortable fit and which efficiently effectuates coverage of the hair. Previous paper caps have employed numerous places for attachment of the crown. In caps where there was an overlap of the marginal edge portion, the crown was often attached near the upper fold. That design wasted space and either resulted in a loose fit, as the side panels rested too low, or else too tight a fit as the panels were adjusted for a snug fit to compensate for the loose crown. If there was no overlap, an attachment occurred either at the bottom of the lower marginal edge or at a point extending around the interior of the cap, but at approximately the vertical mid-point of the head band. This design permitted little stability since so little of the panels were in contact with the head, thereby also causing a loose fit. One of the unique approaches of this invention lies in positioning the crown 12 such that it permits the accommodation of a substantial volume of hair, but more importantly contributes to the engineered fit which this cap possesses.

This cap structure provides for a better fit in that overlapping of the upper and lower marginal edge portions enables the side panels of the cap to acquire substantial rigidity. In addition, the telescopic structure of the side panel 11 imparts some additional rigidity to the cap. This rigidity is of importance to the engineered fit of the cap since it provides support for the crown 12.

While the rigidity is an important aspect of this cap, since it permits the overlapping marginal edge portions to have a locking effect, another advantage of this cap is its large volume due to the crown 12. By placing the crown as shown in FIGS. 11 and 14, a greater volume can be accommodated than in a patent such as U.S. Pat. No. 4,213,206 where the crown attaches to the lower marginal edge portion. In addition to the obtaining of more volume, the upper marginal edge portion can also function as a part of the crown, yet still permit the cap to retain its locking effect due to the overlapping construction of the cap. In fact, where it is anticipated that the cap will contain a large volume of hair, the locking effect may be enhanced by increasing the extent of the overlap. Meanwhile, caps without overlapping edges, such as Pat. No. 4,186,446, are not capable of exercising as substantial a locking effect, since the telescoping marginal edge portions in that patent tend to bend under stress thereby decreasing the rigidity needed to assure the locking effect.

Figure 7:
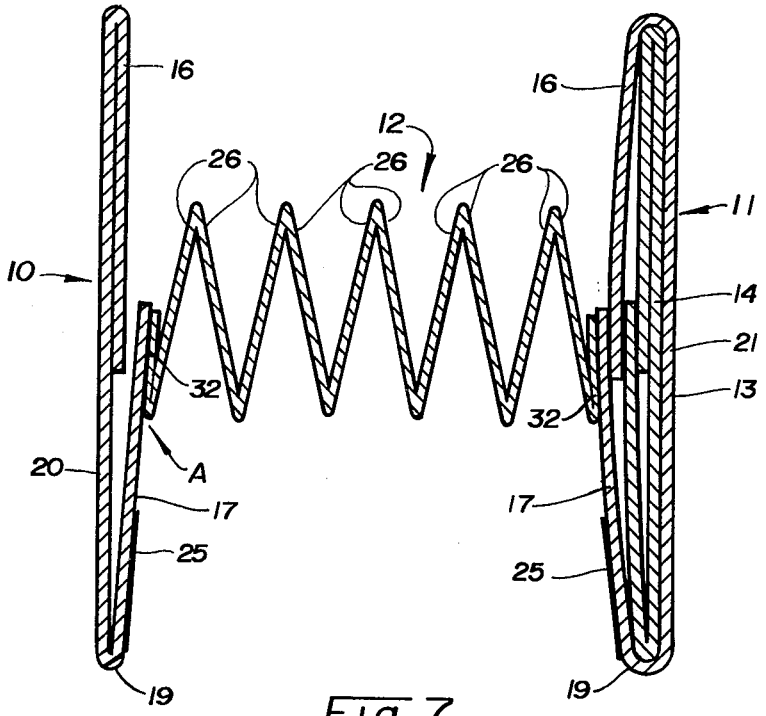
FIG. 7 is a vertical sectional view on an enlarged scale of a modified embodiment of an adjustable paper cap wherein the outermost pleat of the crown is directed in an upward direction.
Figure 8:
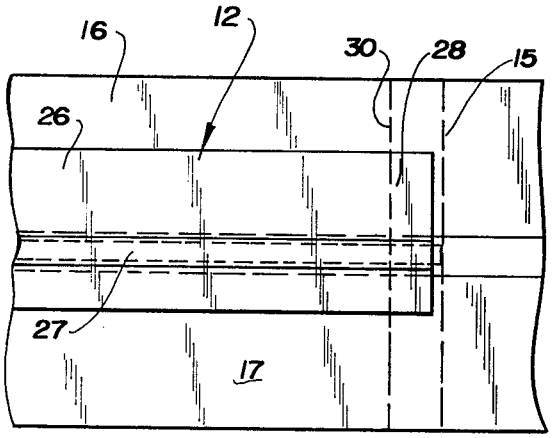
FIG. 8 is a fragmentary elevational view of a modified embodiment of a portion of the interior face of the side panels at the rear fold line juncture with the crown attached as disclosed in FIG. 7.

Considering FIG. 7, there is an overlap, in which the lower marginal edge portion 17 overlaps the upper marginal edge portion 16. However, this cap embodiment is distinguishable from the cap structure of Pat. No. 4,213,206 in that the crown's end pleat and upturned flap 32 extends upwardly while in Pat. No. 4,213,206 the end pleat 26 extends downwardly. This distinction as to direction affects the type of force necessary to separate the crown from the marginal edge portion, with a shearing force necessary in Pat. No. 4,213,206 while a tearing force is necessary for this embodiment.

The first side panel 10 has at its rear portion the crease line 30. When the cap is expanded, the function of the crease line 30 is as shown in FIGS. 1 and 5. The side panel 10 folds along that line as well as the rear fold line 15 to create a cap having two long side panels and one narrow rear panel.

Figure 9:
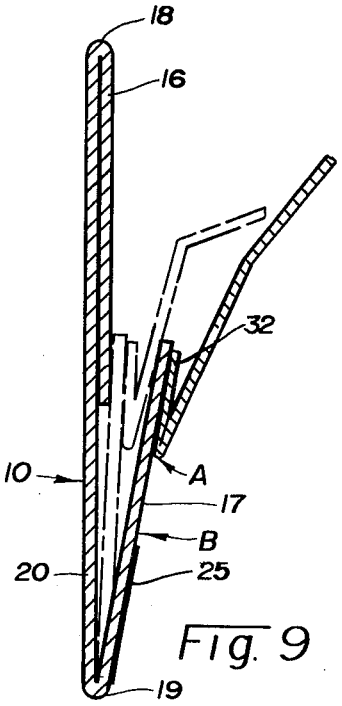
FIG. 9 is a fragmentary vertical sectional view similar to FIG. 7 illustrating functioning of the cap.

Expansion of a cap constructed in accordance with this invention to different extents is shown in FIGS. 7, 9, 11, 13, 14 and 16. In FIG. 7, the cap is shown in a configuration where the side panels 10 and 11 have been spread apart to a very limited extent as in the case of adapting to a relatively small volume of hair. The lower marginal edge portions 17 have remained in substantially parallel relationship to the respective outer walls 20, 21–22 of each side panel and it is only the pleated crown 12 which has expanded to accommodate the separation of the panels, but without any appreciable upward displacement. Attachment of the crown by means of upturned flap 32 at point A on the lower edge portion 17 which has a vertical extent such that it is at approximately the midpoint of the panel's vertical height places the crown at a relative elevation where the crown need only expand in a lateral direction. However, for significantly greater hair volume, the crown 12 is readily capable of further expansion laterally as well as upward displacement as is illustrated in FIG. 9. In the situation shown in full lines, the crown 12 has been expanded to substantially its fullest extent with the several pleat panels 26 forming a generally continuous surface of upwardly curved configuration. Additionally, the lower marginal edge portion 17 has now been flexed inwardly with the point A displaced with the edge portion between point A and a relatively lower point B also assuming a curved configuration. Accommodation of an intermediate volume of hair is illustrated by the broken line representation of the crown 12 in FIG. 9. In this situation, the marginal edge portion 17 remains adjacent to the outer walls, but the pleat panels 26 have been substantially expanded as well as having been upwardly displaced.

In FIG. 11, the cap is shown in a configuration where the side panels 10 and 11 have also been spread apart to a very limited extent as in FIG. 7. In this embodiment, it is the upper marginal edge portions 16 which have remained in substantial parallel relationship to the respective outer walls 20, 21–22 of each side panel and, as in FIG. 7, it is only the pleated crown 12 which has expanded to accommodate the separation of the panel's, but without any appreciable upward displacement. Attachment of the crown 12 occurs on the upper edge portion 16 such that the attachment is at approximately the mid-point of the panel's vertical height and places the crown at a relative elevation where the crown need only expand in a lateral direction. However, for significantly greater hair volume, the crown 12 is readily capable of further expansion laterally as well as upward displacement as is illustrated in FIG. 13. In the situation shown in full lines, the crown 12 has been expanded to substantially its fullest extent with the several pleat panels 26 forming a generally continuous surface of upwardly curved configuration. Accommodation of an intermediate volume of hair is illustrated by the broken line representation of the crown 12 in FIG. 13. In this situation, the marginal edge portion 16 remains adjacent the outer walls, but the pleat panels 26 have been substantially expanded as well as having been upwardly displaced.

Furthermore, in a third embodiment of the cap as shown in FIG. 14, the side panels 10 and 11 have been spread apart to a very limited extent as in the case of adapting to a relatively small volume of hair. The upper marginal edge portions 16 have remained in substantially parallel relationship to the respective outer walls 20, 21–22 of each side panel and as in FIGS. 7 and 11, it is only the pleated crown 12 which has expanded to accommodate the separation of the panels, but without any appreciable upward displacement. Attachment of the crown on the upper edge portion 16 at approximately the mid-point of the panel's vertical height is effected by an upturned flap 32, as in the first embodiment. As in the other embodiments of this invention, the crown 12 is readily capable of expansion laterally as well as upward displacement as is illustrated in FIG. 16. In the situation shown in full lines, the crown 12 has been expanded to substantially its fullest extent with the several pleat panels 26 forming a generally continuous surface of upwardly curved configuration. Accommodation of an intermediate volume of hair is illustrated by the broken line representation of the crown in FIG. 16.

It is readily seen from an examination of the drawing figures that the cap is readily capable of accommodating various hair volumes while maintaining a snug fit. The crown 12 conforms and adapts to the head and hair style and thus maintains a substantial contact throughout which greatly assures that the cap will be securely maintained in position on the wearer's head. By employing the technique of attachment of the crown, as disclosed in this invention, this cap provides comfort to the wearer regardless of their hair style preference. Obtaining this additional degree of comfort is of importance in enhancing a worker's efficiency in assuring a better fitting and more comfortable cap designed with occupational health and safety considerations in mind.

Both longitudinal sides of the crown are attached to the respective panels 10 and 11 as shown in the several drawing figures. Attaching both sides provides for maximum hair coverage and also for better fit since there will be a uniform displacement over the hair as the hair is pressed against the crown. It must be realized that this is accomplished by a minimal overlap of the crown 12 at the rearward end fold line 15 as shown in FIG. 7. Some overlap is necessary to assure that the crown 12 will be securely attached as desired. However, a large overlap serves to waste material. Therefore, a minimal overlap, such as this invention possesses, maximizes the obtaining of objectives for minimizing the use of materials and minimizes the possibility of obstructing relative telescopic movement of the front and rear sections 13 and 14 of the second side panel 11. The lack of attachment of the crown to lower marginal portion 17 of the rear panel section 14 materially contributes to the minimal interference between crown and side panel during size adjustments while assuring that the crown will be substantially uniformly expanded throughout, thereby avoiding any gap between the crown and rear section 14 of the second side panel 11.

In addition to the fact that the minimal overlap contributes to the obtaining of objectives, both the pleated structure of the crown and the telescopic structure of the side panels 10 and 11 also serve to minimize materials. The point of attachment of the pleated crown 12 in all embodiments allows for a smaller vertical displacement between an initial assembled position of the crown and the position attained by the crown when the cap is worn. Previously known crown structures utilized more paper to effectuate the same degree of coverage since a larger vertical displacement of the crown is required, especially near the front and rear ends of the cap.

Also, the telescopic structure used in this invention minimizes the use of materials in two ways. First, there is the use of only single folded longitudinal marginal edge portions 16 and 17. Utilizing one fold is sufficient to permit the ends to telescope effectively. The use of two or more folds, as in the case of many prior cap structures, serves only to waste material and to necessitate extra steps in the production of the cap. Wider longitudinal edges are used to both assure the structural stability of the cap and in the case of the lower marginal edge 17, to assure the incorporation of a more efficient sweat band by the application of a moisture impervious coating 25. By constructing the cap in the manner in which this invention is constructed, the use of materials is minimized, yet the stated objectives are achieved.

Finally, the use of paper in the construction of both the crown 12 and side panels 10 and 11 results in relatively low manufacturing costs and consequently a low sales price. Furthermore, since the cap is relatively inexpensive to manufacture, it allows disposal of the cap after one time day's use in order to maintain sanitary and aesthetic working conditions. Sanitary working conditions are maintained by the replacement of a soiled cap by a clean new one. Similarly, the replacement of an unattractive soiled cap by a fresh cap is aesthetically pleasing to fellow workers and the public in general.

It will be readily apparent from the foregoing detailed description of an illustrative embodiment of this invention that a particularly novel and extremely effective adjustable paper cap is provided. This cap is capable of providing for an extremely comfortable fit yet one which accommodates sufficient amounts of hair to comply with occupational health and safety standards due to its unique functional characteristics. Attaching the crown, as shown, to the appropriate marginal edge portion coupled with the downwardly directed orientation of the outermost panels of the pleated crown materially enhances the ability of the cap to fit in both a snug and comfortable fashion.

Having thus described this invention, what is claimed is:

1. An adjustable cap comprising first and second elongated side panels with respective opposite ends adapted to be disposed in co-extensive relationship with each panel having opposed upper and lower longitudinally extending edges, each of said first and second panels having a marginal edge portion at each longitudinally extending edge folded relatively inwardly thereof into superimposed relationship between said two panels, said upper and lower marginal edge portions overlapping with the lower edge portion projecting a distance upwardly to overlap with the upper edge portion, said second panel being formed with a front section and a rear section extending in longitudinally aligned overlapping relationship with adjacent ends of the front and rear sections telescopically interconnected to permit relative longitudinal displacement thereof for selective size adjustment, said interconnected sections having the overlapping marginal edge portions of the one section telescopically positioned interiorly of the overlapping marginal edge portions of the other section, each of said front and rear sections having their opposite ends connecting with a respective end of said first panel, and an elongated crown formed from flexible sheet material and having a plurality of longitudinally extending pleated panels with an outermost pleat panel at each side thereof projecting upward from its line of connection with the adjacent pleat panel and secured to an inwardly facing surface of the innermost positioned marginal edge portion of said first and second panel, said pleated panels disposed in coplanar relationship to said side panels when said crown is collapsed to a fully folded configuration.

2. An adjustable cap according to claim 1 wherein said crown has a rear vertical end edge portion having the pleated panels gathered into coplanar relationship and reverse folded upon itself, said vertical end edge portion being adhesively secured to the respective inwardly facing surface of the upper marginal edge portion of that section of the second panel to which said crown is not otherwise secured.

3. An adjustable cap according to claim 2 wherein an adhesive bonding material is applied to extreme end edge portions of each pleated panel of said crown at said vertical end edge portions.

4. An adjustable cap according to claim 3 wherein said edge portions overlap centrally of the vertical extent of said panels.

5. An adjustable cap according to claim 4 wherein each of said side panels is provided with a longitudinally extending band comprising a coating of moisture resisting material formed on the inwardly facing surface of said upper marginal edge portion.

6. An adjustable cap comprising first and second elongated side panels with respective opposite ends adapted to be disposed in co-extensive relationship with each panel having opposed upper and lower longitudinally extending edges, each of said first and second panels having a marginal edge portion at each longitudinally extending edge folded relatively inwardly thereof into superimposed relationship between said two panels, said upper and lower marginal edge portions overlapping with the lower edge portion projecting a distance upwardly to partially cover the upper edge portion, said second panel being formed with a front section and a rear section extending in longitudinally aligned overlapping relationship with adjacent ends of the front and rear sections telescopically interconnected to permit relative longitudinal displacement thereof for selective size adjustment, said interconnected sections having the overlapping marginal edge portions of the one section telescopically positioned interiorly of the overlapping marginal edge portions of the other section, each of said front and rear sections having their opposite ends connecting with a respective end of said first panel, an elongated crown formed from flexible sheet material and having a plurality of longitudinally extending pleated panels with an outermost pleat panel at each side thereof projecting upwardly from its line of connection with the adjacent pleat panel and secured to an inwardly facing surface of a respective lower marginal edge portion of said first and second panel, said pleated panels disposed in coplanar relationship to said side panels when said crown is collapsed to a fully folded configuration.

7. An adjustable cap according to claim 6 wherein said crown has a rear vertical end edge portion having the pleated panels gathered onto coplanar relationship and reverse folded upon itself, said vertical end edge portion being adhesively secured to the respective inwardly facing surface of the lower marginal edge portion of that section of the second panel to which said crown is not otherwise secured.

8. An adjustable cap according to claim 7 wherein an adhesive bonding material is applied to extreme end edge portions of each pleated panel of said crown at said vertical end edge portions.

9. An adjustable cap according to claim 8 wherein said edge portions overlap centrally of the vertical extent of said panels.

10. An adjustable cap according to claim 9 wherein each of said side panels is provided with a longitudinally extending band comprising a coating of moisture resisting material formed on the inwardly facing surface of said lower marginal edge portion.

11. An adjustable cap comprising first and second elongated side panels with respective opposite ends adapted to be disposed in co-extensive relationship with each panel having opposed upper and lower longitudinally extending edges, each of said first and second panels having a marginal edge portion at each longitudinally extending edge folded relatively inwardly thereof into superimposed relationship between said two panels, said upper and lower marginal edge portions overlapping with the upper edge portion projecting a distance downwardly to partially cover the lower edge portion, said second panel being formed with a front section and a rear section extending in longitudinally aligned overlapping relationship with adjacent ends of the front and rear sections telescopically interconnected to permit relative longitudinal displacement thereof for selective size adjustment, said interconnected sections having the overlapping marginal edge portions of the one section telescopically positioned interiorly of the overlapping marginal edge portions of the other section, each of said front and rear sections having their opposite ends connecting with a respective end of said first panel, and an elongated crown formed from flexible sheet material and having a plurality of longitudinally extending pleated panels with an outermost pleat panel at each side thereof secured to an inwardly facing surface of the innermost positioned marginal edge portion of said first and second panel, said pleated panels disposed in coplanar relationship to said side panels when said crown is collapsed to a fully folded configuration.

12. An adjustable cap according to claim 11 wherein said outermost pleat panel projects upwardly from its line of connection with the adjacent pleat panel.

13. An adjustable cap according to claim 11 wherein said outermost pleat panel projects downwardly from its line of connection with the adjacent pleat panel.

14. An adjustable cap according to claims 12 or 13 wherein said crown has a rear vertical end edge portion having the pleated panels gathered into coplanar relationship and reverse folded upon itself, said vertical end edge portion being adhesively secured to the respective inwardly facing surface of the upper marginal edge portion of that section of the second panel to which said crown is not otherwise secured.

15. An adjustable cap according to claim 14 wherein an adhesive bonding material is applied to extreme end edge portions of each pleated panel of said crown at said vertical end edge portions.

16. An adjustable cap according to claim 15 wherein said edge portions overlap centrally of the vertical extend of said panels.

17. An adjustable cap according to claim 16 wherein each of said side panels is provided with a longitudinally extending band comprising a coating of moisture resisting material formed on the inwardly facing surface of said upper marginal edge portion.

* * * * *